US011306530B1

(12) United States Patent
Krause

(10) Patent No.: US 11,306,530 B1
(45) Date of Patent: Apr. 19, 2022

(54) GARAGE FLOOR BARRICADE AND ASSOCIATED METHODS

(71) Applicant: Karl Krause, Jacksonville, FL (US)

(72) Inventor: Karl Krause, Jacksonville, FL (US)

( * ) Notice: Subject to any disclaimer, the term of this patent is extended or adjusted under 35 U.S.C. 154(b) by 0 days.

(21) Appl. No.: 17/375,226

(22) Filed: Jul. 14, 2021

Related U.S. Application Data

(60) Provisional application No. 63/082,922, filed on Sep. 24, 2020.

(51) Int. Cl.
*E06B 7/23* (2006.01)

(52) U.S. Cl.
CPC ..... *E06B 7/2316* (2013.01)

(58) Field of Classification Search
CPC . E06B 7/22; E06B 7/23; E06B 7/2301; E06B 7/2303; E06B 7/2305; E06B 7/2307; E06B 7/2309; E06B 7/231; E06B 7/2312; E06B 7/2316; E06B 7/232; E04B 1/68; E04B 1/6804; E04B 1/6806; E04B 1/6807; E04B 1/6812; E01D 19/06; E02B 7/005
USPC ..... 415/107, 115
See application file for complete search history.

(56) References Cited

U.S. PATENT DOCUMENTS 3,320,706 A * 5/1967 Elliott ..... E04D 3/38 52/393
3,461,781 A * 8/1969 Weiner ..... E01C 11/106 404/48
3,861,081 A * 1/1975 Maskell ..... E06B 9/00 49/70
3,951,562 A * 4/1976 Fyfe ..... E01C 11/106 404/68
3,956,557 A * 5/1976 Hurst ..... E04B 1/6806 428/167
4,127,350 A * 11/1978 Weber ..... E01C 11/106 404/65
4,522,413 A * 6/1985 Nicholas ..... E01C 11/106 277/645
4,558,875 A * 12/1985 Yamaji ..... C09K 3/10 106/DIG. 4
4,572,702 A * 2/1986 Bone ..... E01D 19/06 14/73.5
4,685,825 A * 8/1987 Buckenauer ..... E01D 19/06 404/65
4,699,540 A * 10/1987 Gibbon ..... E01D 19/06 404/49
4,717,162 A * 1/1988 Trieste ..... E01D 19/06 277/645
4,740,404 A * 4/1988 Otsugu ..... E01C 11/106 404/64
4,743,036 A * 5/1988 Nicholas ..... E01D 19/06 277/645

(Continued)

*Primary Examiner* — Kyle J. Walraed-Sullivan
(74) *Attorney, Agent, or Firm* — Ashkan Najafi

(57) ABSTRACT

A garage floor barricade is inserted into a seam between two slabs of concrete at a garage floor entrance of a garage for prohibiting fluid and debris from traveling past the garage floor entrance (e.g., ground level) into the garage. The barricade includes a single and continuous body having a flanged bottom edge adapted to be inserted into a seam between two slabs of concrete at the garage floor entrance of the garage. An adhesive member adapted to be deposited into the seam and configured to be engaged with the flanged bottom edge such that a planar medial portion of the body remains sufficiently upright above the seam between the two slabs of concrete.

11 Claims, 14 Drawing Sheets

(56) References Cited

U.S. PATENT DOCUMENTS 4,749,307 A * 6/1988 Huffaker ..... E02B 3/16 405/119
5,054,536 A * 10/1991 Leist ..... E05D 15/242 160/229.1
5,071,282 A * 12/1991 Brown ..... E01C 11/126 404/68
5,213,441 A * 5/1993 Baerveldt ..... E01D 19/06 404/66
5,438,802 A * 8/1995 Johnson ..... E06B 7/22 49/475.1
5,649,784 A * 7/1997 Ricaud ..... E01C 11/103 14/73.1
5,888,017 A * 3/1999 Corrie ..... E01C 11/106 404/64
6,039,503 A * 3/2000 Cathey ..... E01C 11/10 14/73.1
6,061,967 A * 5/2000 Judds ..... E06B 1/70 49/304
6,219,982 B1 * 4/2001 Eyring ..... E04B 1/6803 52/393
6,298,621 B1 * 10/2001 Lee ..... E02D 5/185 52/302.6
6,491,468 B1 * 12/2002 Hagen ..... E04B 1/6803 277/316
7,214,005 B1 * 5/2007 Davis ..... E02B 3/102 405/114
8,769,875 B1 * 7/2014 Scoggins ..... E06B 1/70 49/467
8,769,876 B2 * 7/2014 Albanese ..... E06B 7/2307 49/489.1
9,423,059 B1 * 8/2016 Sorkin ..... E04C 5/10
10,557,263 B1 * 2/2020 Robinson ..... E04B 1/6804
10,895,104 B1 * 1/2021 Hertel ..... E06B 9/00
11,124,973 B2 * 9/2021 Clement ..... B32B 5/16
2003/0190193 A1 * 10/2003 Waters, Jr. ..... E06B 9/04 405/110
2004/0055235 A1 * 3/2004 Valentine ..... E01C 23/026 52/396.02
2004/0173977 A1 * 9/2004 Drouin ..... E04B 1/6807 277/628
2006/0283117 A1 * 12/2006 Williams ..... E04F 13/0889 52/393
2010/0058696 A1 * 3/2010 Mills ..... E01C 11/126 52/396.05
2010/0095620 A1 * 4/2010 Wilkes, Jr. ..... E04B 1/6813 52/396.04
2011/0047884 A1 * 3/2011 Schroder ..... E06B 7/26 49/484.1
2011/0110722 A1 * 5/2011 van den Noort ..... E02B 3/104 405/87
2012/0079771 A1 * 4/2012 Meulemans ..... E06B 7/2305 49/484.1
2013/0272794 A1 * 10/2013 Osborne ..... E06B 9/02 405/110
2014/0241787 A1 * 8/2014 Campbell ..... E04B 1/681 403/28
2015/0113745 A1 * 4/2015 Haydu ..... E01D 19/06 14/73.1
2015/0117952 A1 * 4/2015 Gujer ..... E04H 9/145 405/96
2016/0145861 A1 * 5/2016 Wexler ..... E06B 9/02 52/202
2016/0201281 A1 * 7/2016 Roy ..... E02B 3/102 405/107
2016/0251868 A1 * 9/2016 Close ..... E04H 7/18 52/293.1
2017/0175527 A1 * 6/2017 Van Stee ..... E02D 29/063
2017/0292262 A1 * 10/2017 Hensley ..... E04B 1/6804
2018/0010330 A1 * 1/2018 Hamilton ..... E01C 11/126
2018/0080277 A1 * 3/2018 Steinke ..... E06B 7/2312
2019/0323347 A1 * 10/2019 Hensley ..... E21D 11/385
2019/0345759 A1 * 11/2019 Quek ..... E06B 7/2314
2020/0011127 A1 * 1/2020 Fernandez-Cuervo ..... E04H 9/145
2020/0157877 A1 * 5/2020 McKinnon ..... E06B 7/2305
2020/0332516 A1 * 10/2020 McNamara ..... E04B 1/41
2021/0116487 A1 * 4/2021 Rhee ..... G01N 22/02
2021/0123193 A1 * 4/2021 Trivedi ..... E04G 23/0214
2021/0170628 A1 * 6/2021 Predl ..... B28B 1/008
2021/0222422 A1 * 7/2021 Griffith ..... E04F 19/062
2021/0238844 A1 * 8/2021 Braker ..... F16J 15/108
2021/0317701 A1 * 10/2021 Azer ..... E06B 7/22

* cited by examiner

GARAGE FLOOR BARRICADE AND ASSOCIATED METHODS

CROSS REFERENCE TO RELATED APPLICATIONS

This is a non-provisional patent application that claims priority to and benefit of U.S. provisional patent application No. 63/082,922 filed Sep. 24, 2020, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to garage floor barricades and, more particularly, to a specially configured garage floor barricade that is inserted into a seam between two slabs of concrete at a garage floor entrance of a garage for prohibiting fluid and debris from traveling past the garage floor entrance (e.g., ground level) into the garage.

Prior Art

Overhead garage doors are sometimes equipped with a seal or weatherstrip which is attached to the bottom surface of the door and is designed to contact the driveway or garage floor to prevent or minimize water intrusion and wind infiltration. Such seals are normally designed to rest directly on the concrete, asphalt, or other driveway surface and, in general, present either an inverted U-shape or a rounded or oblong cross-sectional configuration. Both typical shapes are normally compressed by the weight of the door to effect sealing with the underlying pavement.

Weatherstripping of this type must endure wide temperature swings of the underlying pavement as well as shock loads imposed by the garage doors upon their closing. Temperatures may vary greatly in a single day as well as from season to season. In northern climates, problems are often experienced with the weatherstripping freezing to the concrete slab and then tearing as the door is opened. Shock loads may also vary greatly depending on factors such as overall door weight and the method of closing the door, i.e. automatic closing or manual closing.

For these and other reasons, weatherstripping such as that described above normally has a limited life span. As the product deteriorates, infiltration from moisture, wind, insects and even rodents becomes a problem which normally can only be remedied successfully by replacement as repair is generally not a viable option. Where deterioration of the seal is significant, replacement may be further hindered by deterioration or rotting of the door itself, which may require repair or partial replacement of the lower edge of the door before a new seal can be installed.

Accordingly, a need remains for a garage floor barricade in order to overcome at least one of the above-noted shortcomings. The exemplary embodiment(s) satisfy such a need by a specially configured garage floor barricade that is inserted into a seam between two slabs of concrete at a garage floor entrance of a garage, and that is convenient and easy to use, lightweight yet durable in design, versatile in its applications, and designed for prohibiting fluid and debris from traveling past the garage floor entrance (e.g., ground level) into the garage.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a specially configured garage floor barricade that is inserted into a seam between two slabs of concrete at a garage floor entrance of a garage for prohibiting fluid and debris from traveling past the garage floor entrance (e.g., ground level) into the garage. These and other objects, features, and advantages of the non-limiting exemplary embodiment(s) are provided by a garage floor barricade for prohibiting fluid and debris from traveling beyond a threshold location into the garage. Such a garage floor barricade includes a body having a planar medial portion and a flanged bottom edge directly engaged thereto. Advantageously, the flanged bottom edge is configured to be inserted into an existing seam between two existing slabs of concrete located at the existing garage floor entrance of the garage. A morphable adhesive member is configured to be deposited into the seam and configured to be engaged with the flanged bottom edge such that the planar medial portion of the body remains upright above the seam between the two existing slabs of concrete. Notably, the body has a centrally registered axis aligned with the planar medial portion and offset from the flanged bottom edge. In this manner, the body has a uniform height extended along an entire longitudinal length thereof.

In a non-limiting exemplary embodiment, the body is single, unitary, and continuous and an elastomeric material.

In a non-limiting exemplary embodiment, the body is a rubber wall base configured to be affixed against an existing interior drywall.

In a non-limiting exemplary embodiment, the planar medial portion is monolithically attached to the flanged bottom edge, the planar medial portion having a smooth and continuous anterior face and a smooth and continuous posterior face.

In a non-limiting exemplary embodiment, the smooth and continuous anterior face is symmetrical to and a mirror image of the smooth and continuous posterior face.

In a non-limiting exemplary embodiment, the flanged bottom edge protrudes outwardly and downwardly away from the smooth and continuous anterior face.

In a non-limiting exemplary embodiment, the body is flexible, resilient and includes a surface area having a uniform cross-sectional thickness.

In a non-limiting exemplary embodiment, the body is configured to extend orthogonally upward from the existing garage floor entrance along the centrally registered axis.

In a non-limiting exemplary embodiment, the adhesive member includes a silicon directly abutted against the smooth and continuous anterior face and the flanged bottom edge, such that the silicon is configured to morph and fill the existing seam up to the existing garage floor entrance.

The present disclosure further includes a method of utilizing a garage floor barricade for prohibiting fluid and debris from traveling beyond a threshold location into the garage. Such a method includes the steps of: providing a body having a planar medial portion and a flanged bottom edge directly engaged thereto wherein the body has a centrally registered axis aligned with the planar medial portion and offset from the flanged bottom edge, and further has a uniform height extending along an entire longitudinal length thereof; accessing an existing seam between two existing slabs of concrete located at the existing garage floor entrance of the garage; inserting the flanged bottom edge into the existing seam between the two existing slabs of concrete located at the existing garage floor entrance of the garage; providing an adhesive member; depositing the adhesive member into the seam; and engaging the adhesive member with the flanged bottom edge such that the planar medial portion of the body remains upright above the seam between the two existing slabs of concrete.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
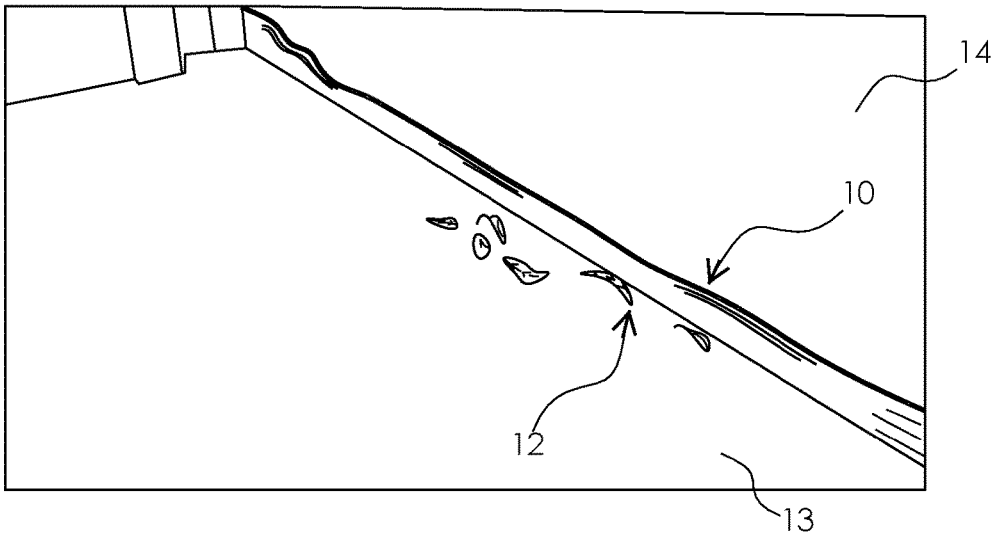
FIG. 1 is a perspective view of a garage floor barricade installed along a seam of two adjoining concrete surface at a garage door entrance, in accordance with a non-limiting exemplary embodiment of the present disclosure.
Figure 2:
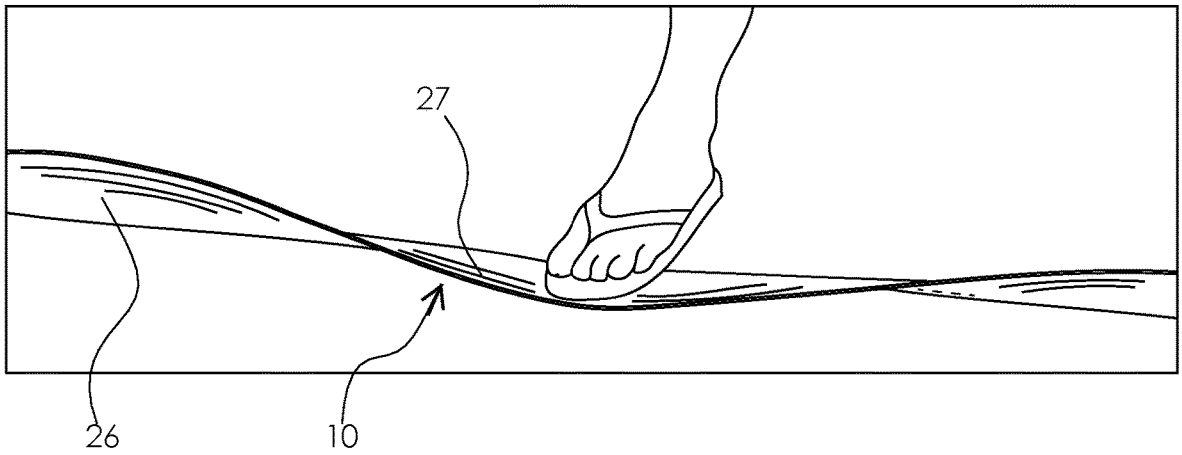
FIG. 2 is another perspective view of the garage floor barricade pressed over to its side while remaining intact at the seam of the two adjoining concrete surface at a garage door entrance.
Figure 3:
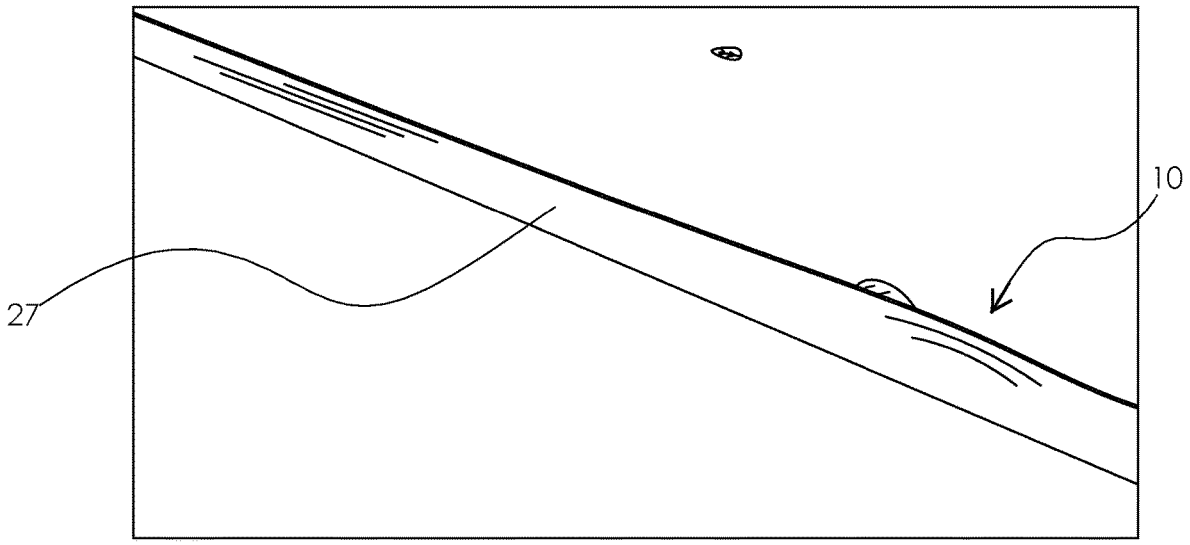
FIG. 3 is another perspective view showing a posterior face of the garage floor barricade.
Figure 4:
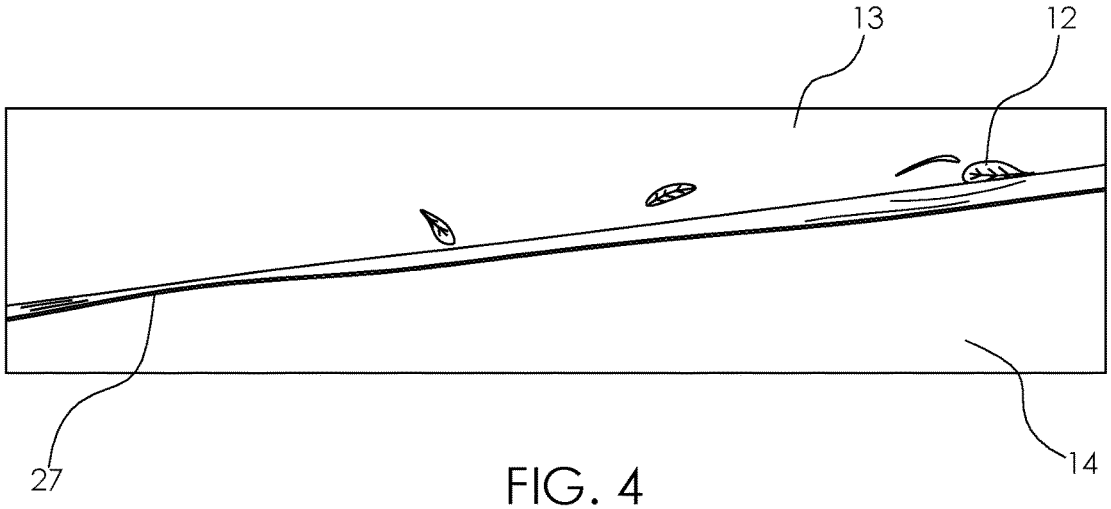
FIG. 4 is another perspective view of the garage floor barricade.
Figure 5:
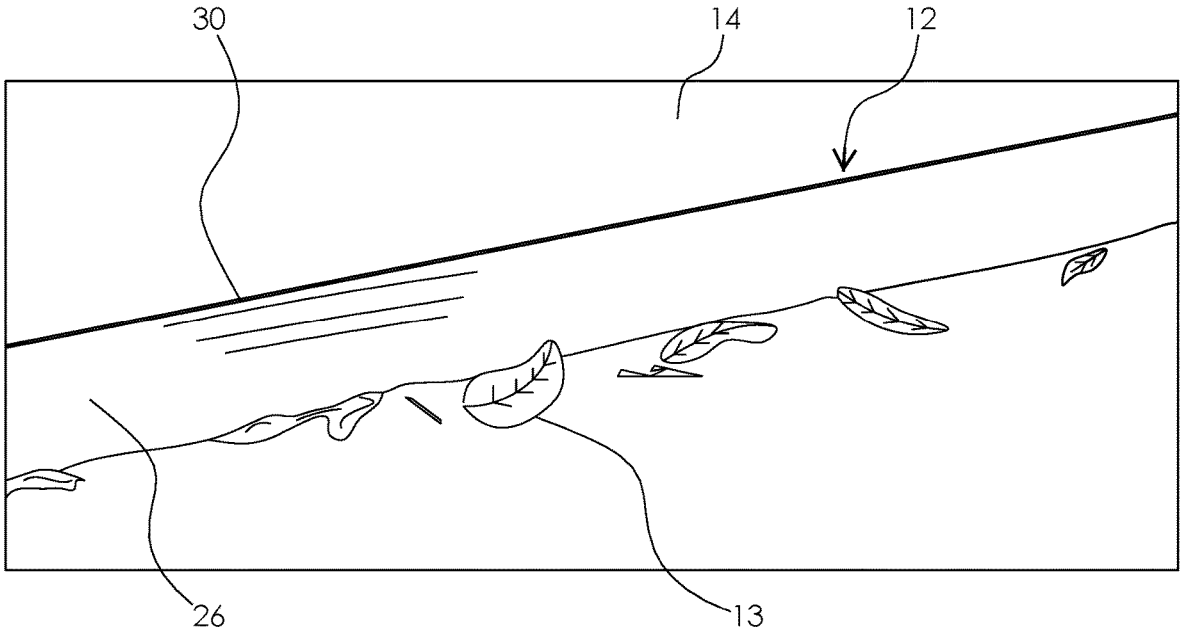
FIG. 5 is another perspective view showing an anterior side of the garage door barricade.
Figure 6:
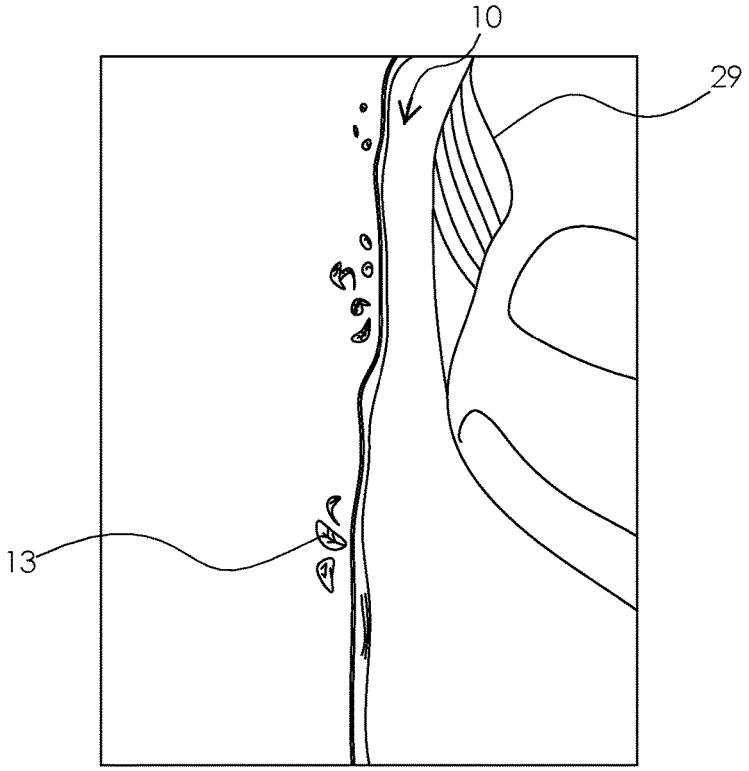
FIG. 6 is another perspective view of the garage floor barricade.
Figure 7:
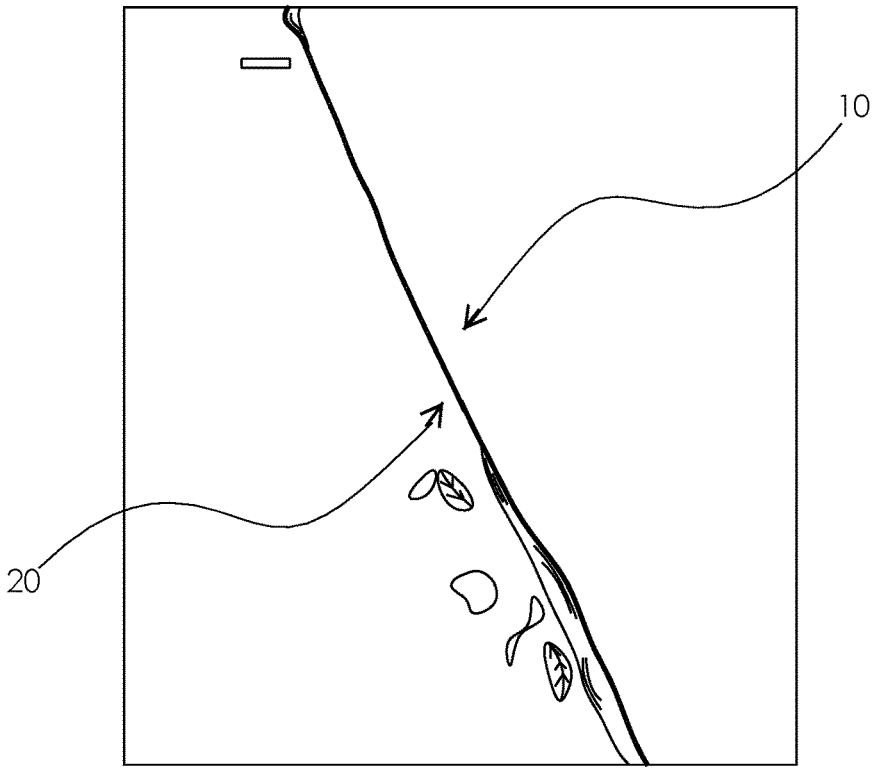
FIG. 7 is another perspective view of the garage floor barricade.
Figure 8:
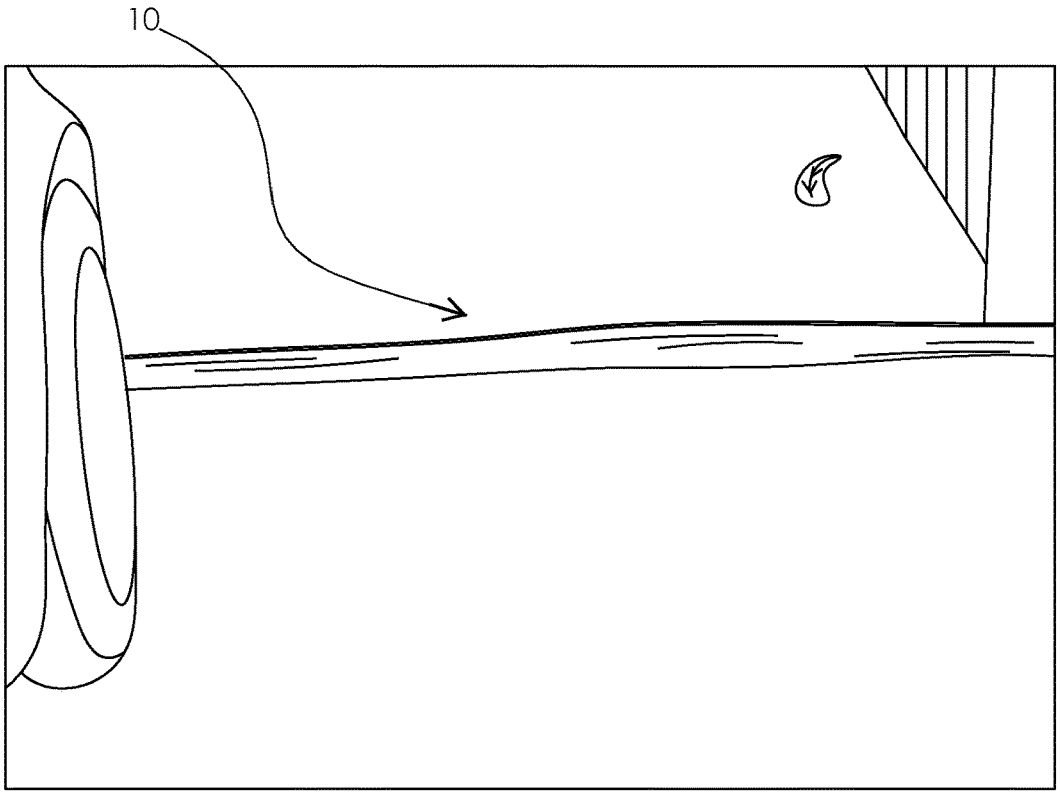
FIG. 8 is another perspective view showing the posterior side of the garage floor barricade.
Figure 9:
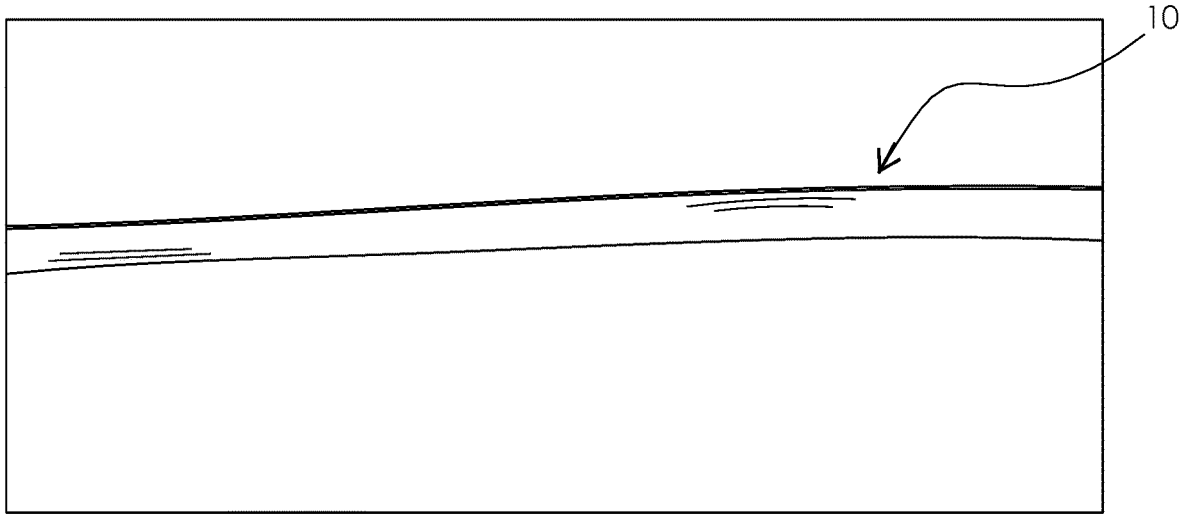
FIG. 9 is another perspective view showing the posterior side of the garage floor barricade.
Figure 10:
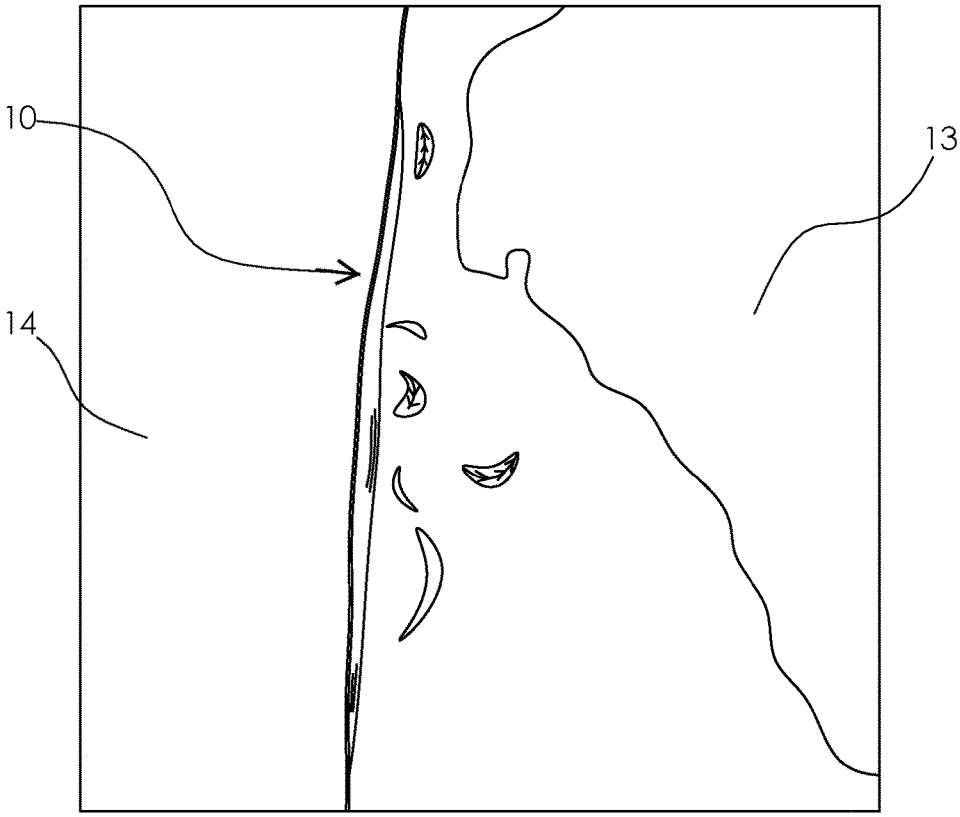
FIG. 10 is another perspective view of the garage floor barricade.
Figure 11:
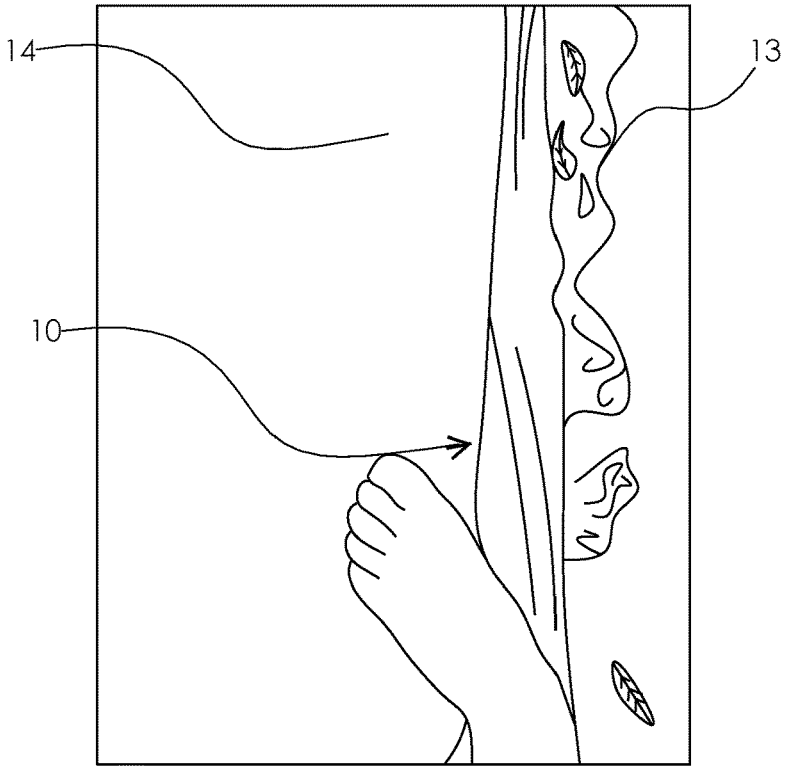
FIG. 11 is another perspective view showing the anterior side of the garage floor barricade.
Figure 11A:
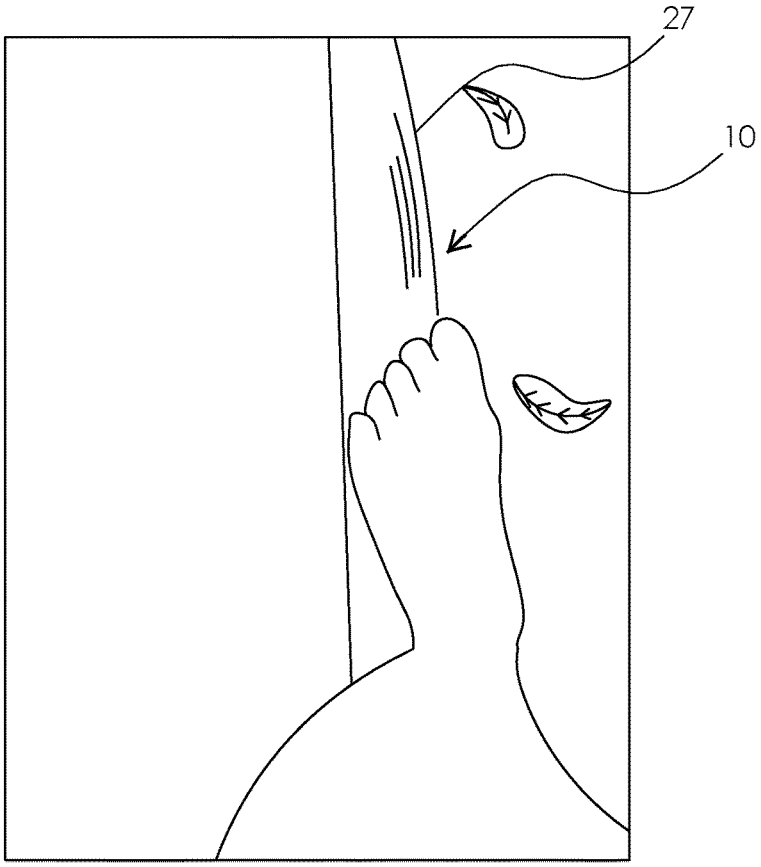
Figure 12:
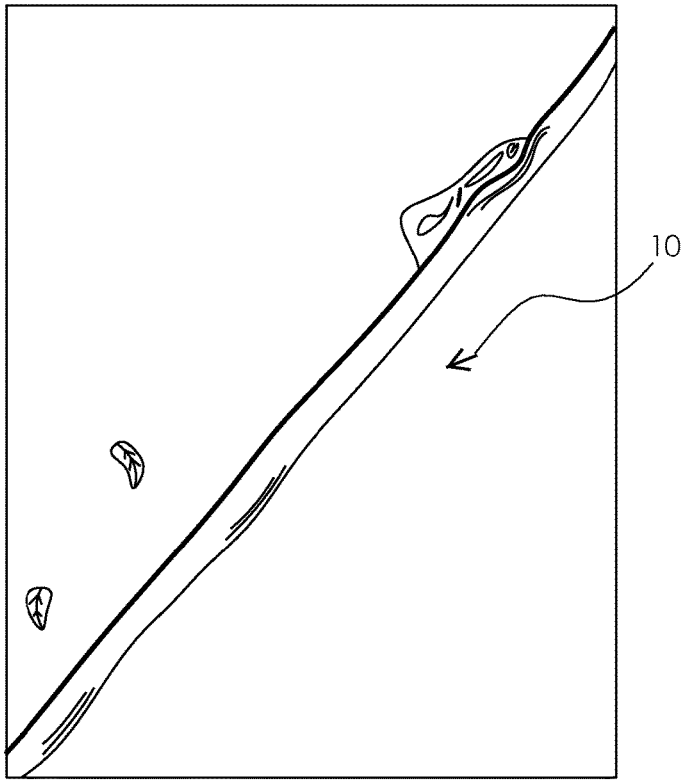
Figure 13:
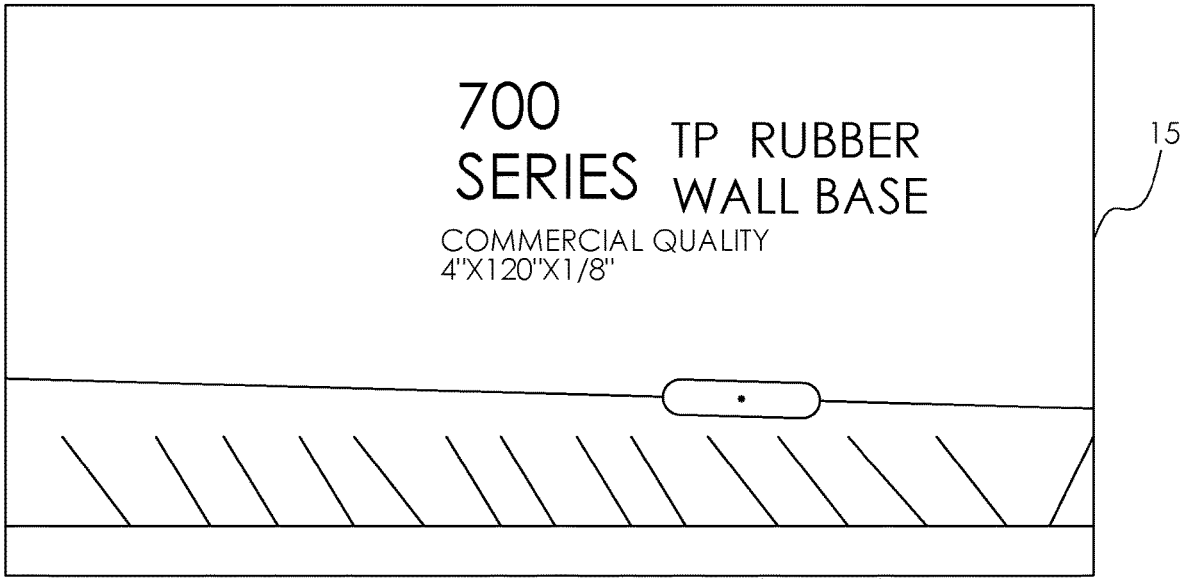
Figure 14:
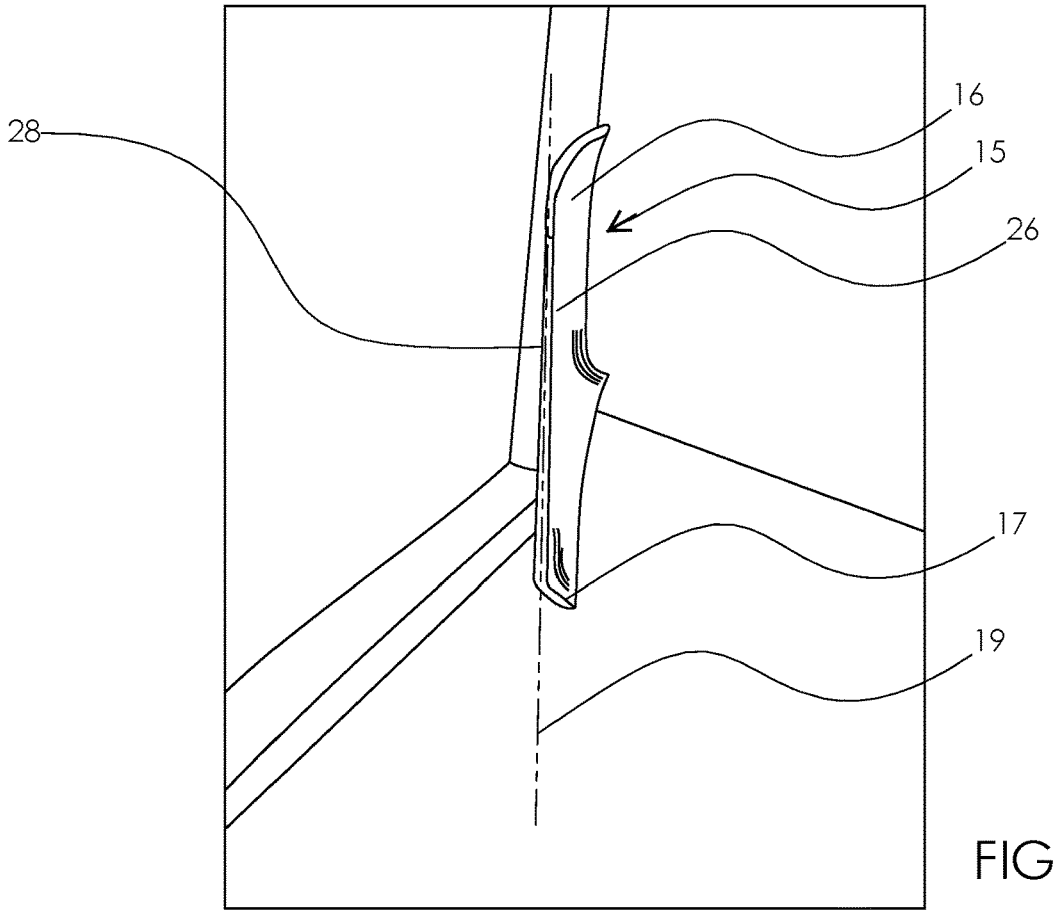
Figure 15:
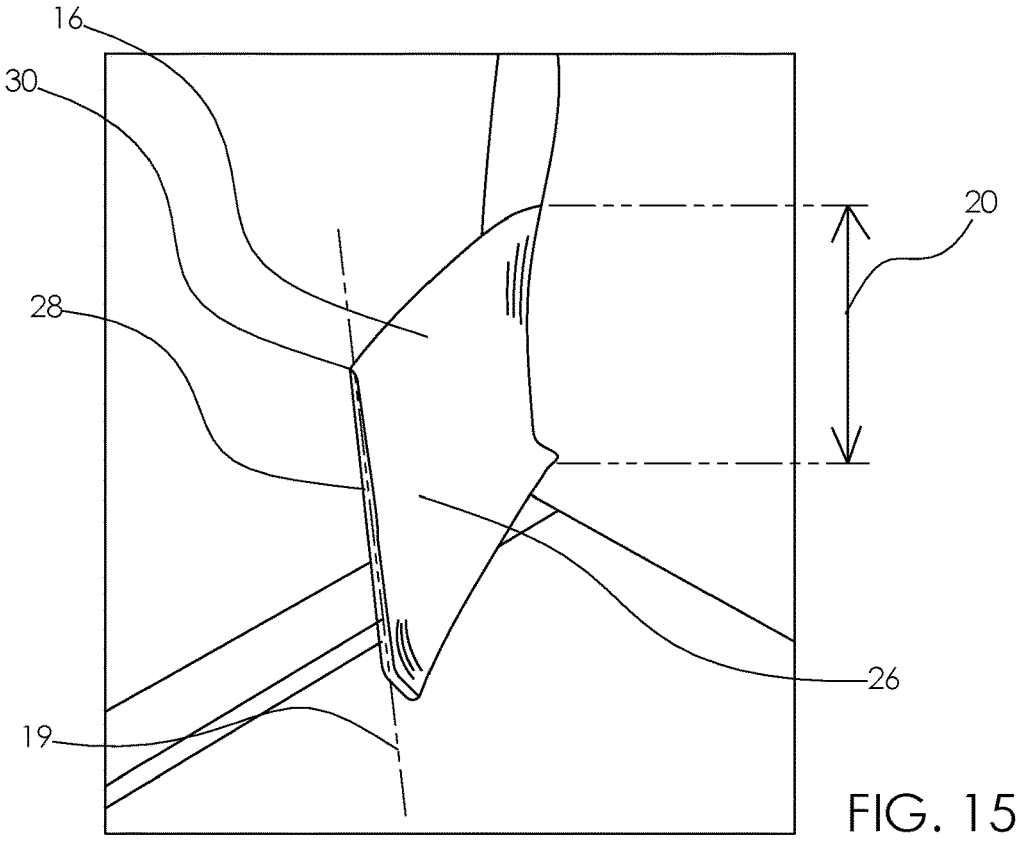
Figure 16:
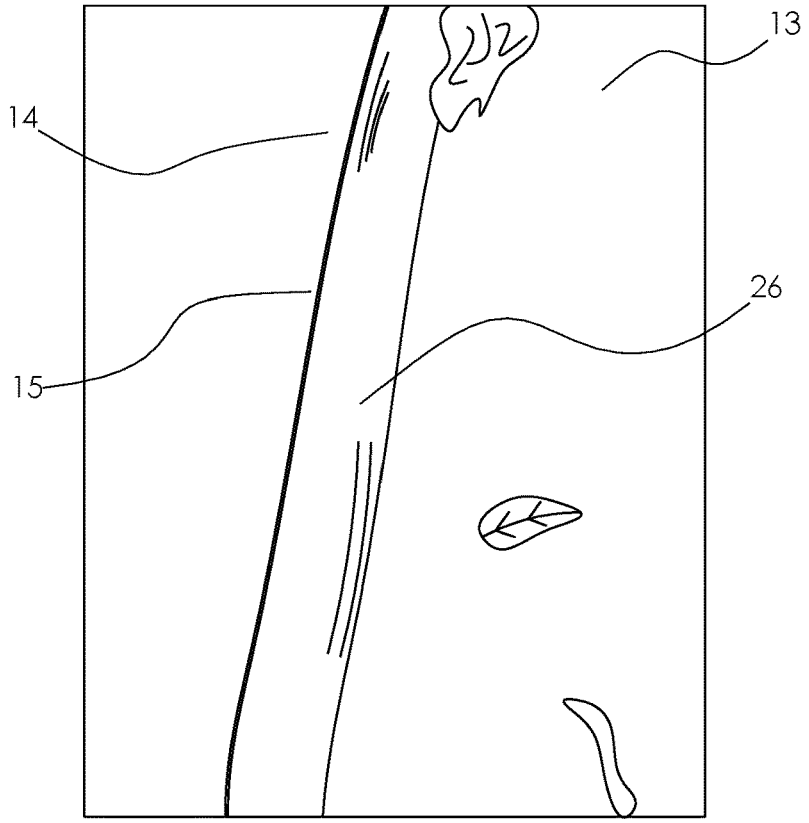
Figure 17:
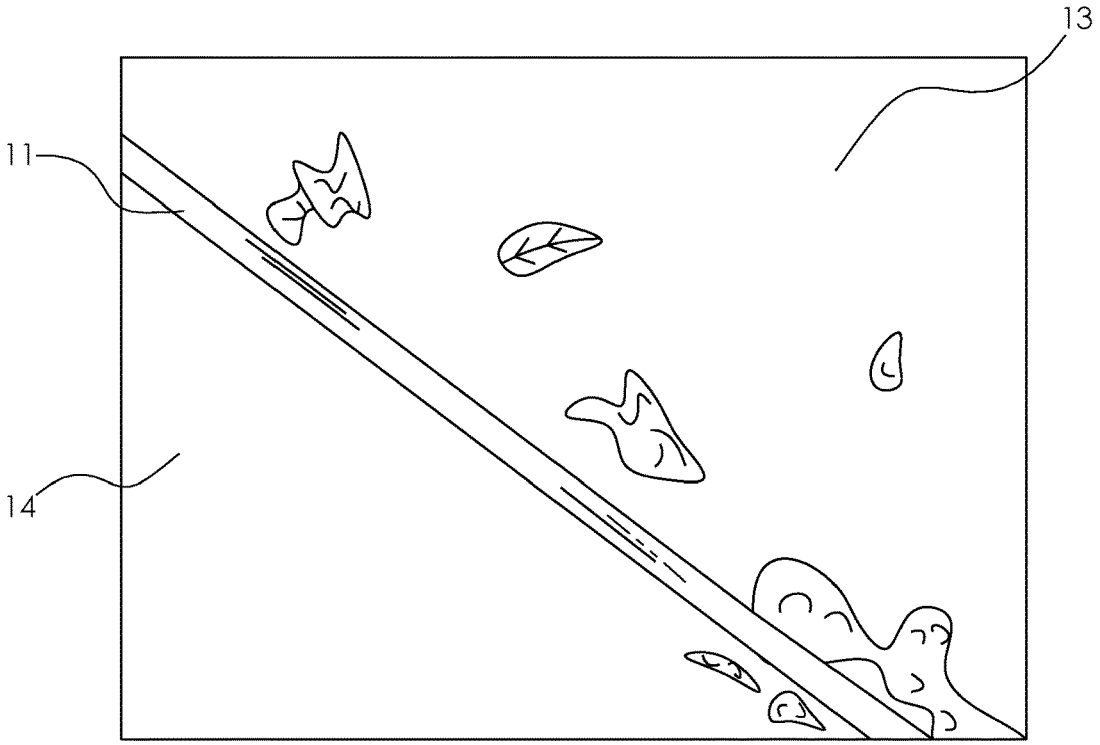
Figure 18:
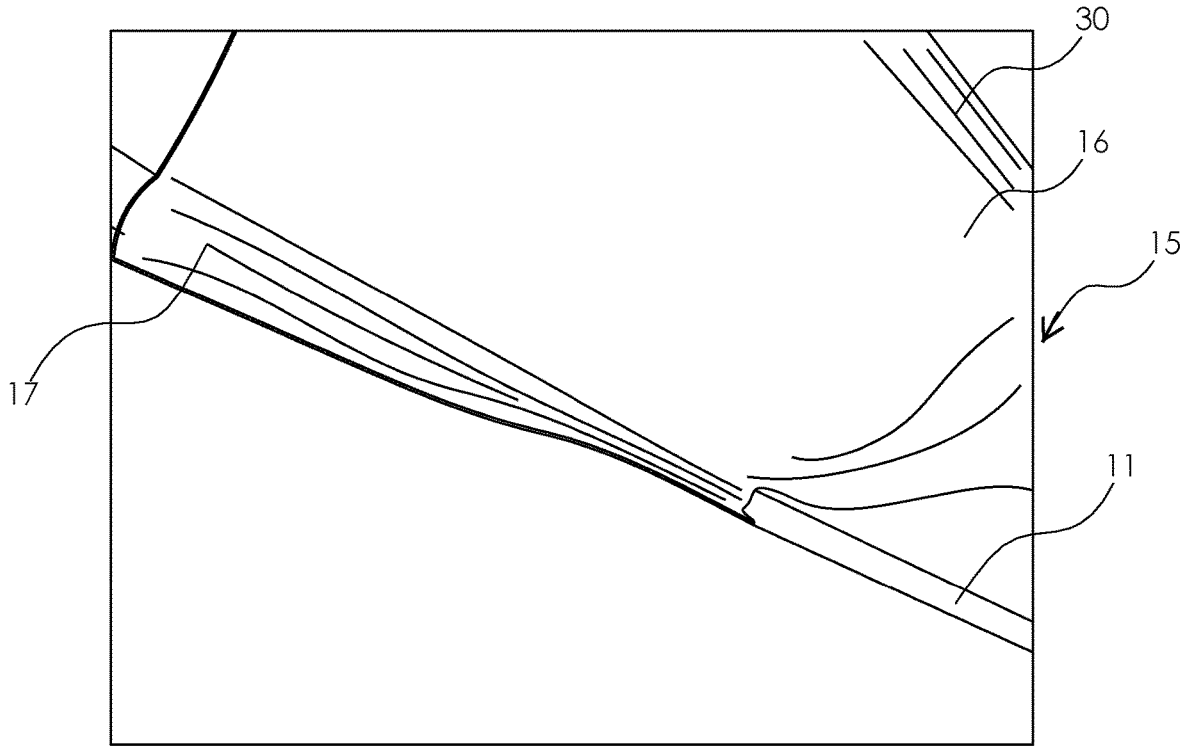
Figure 19:
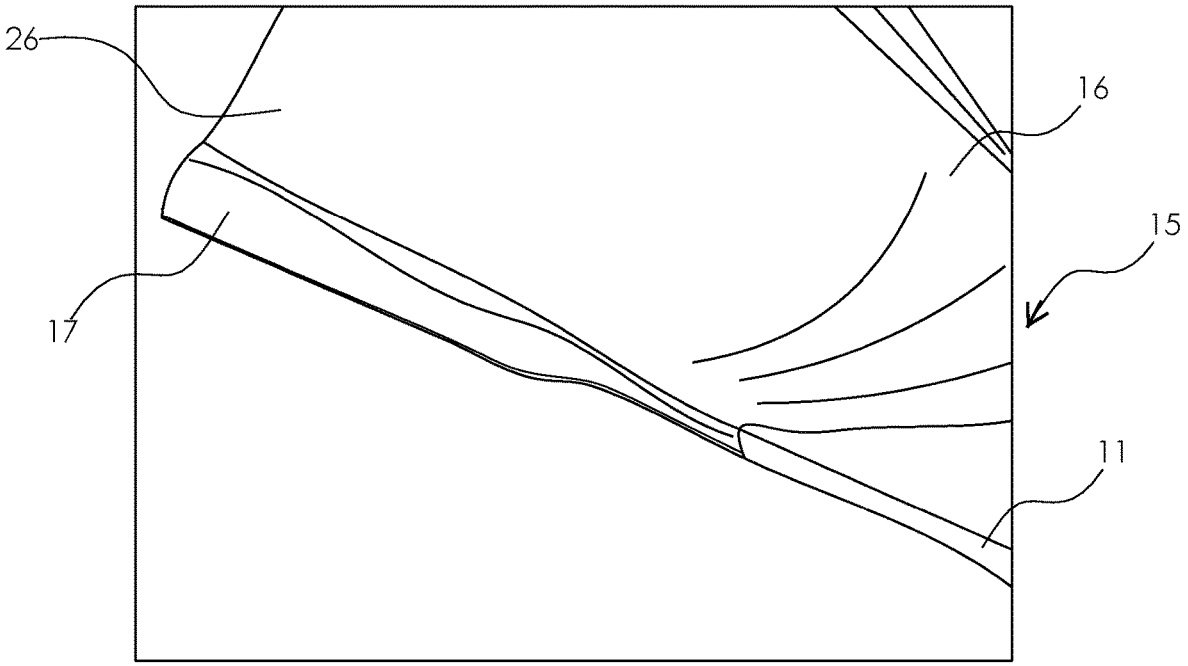
Figure 20:
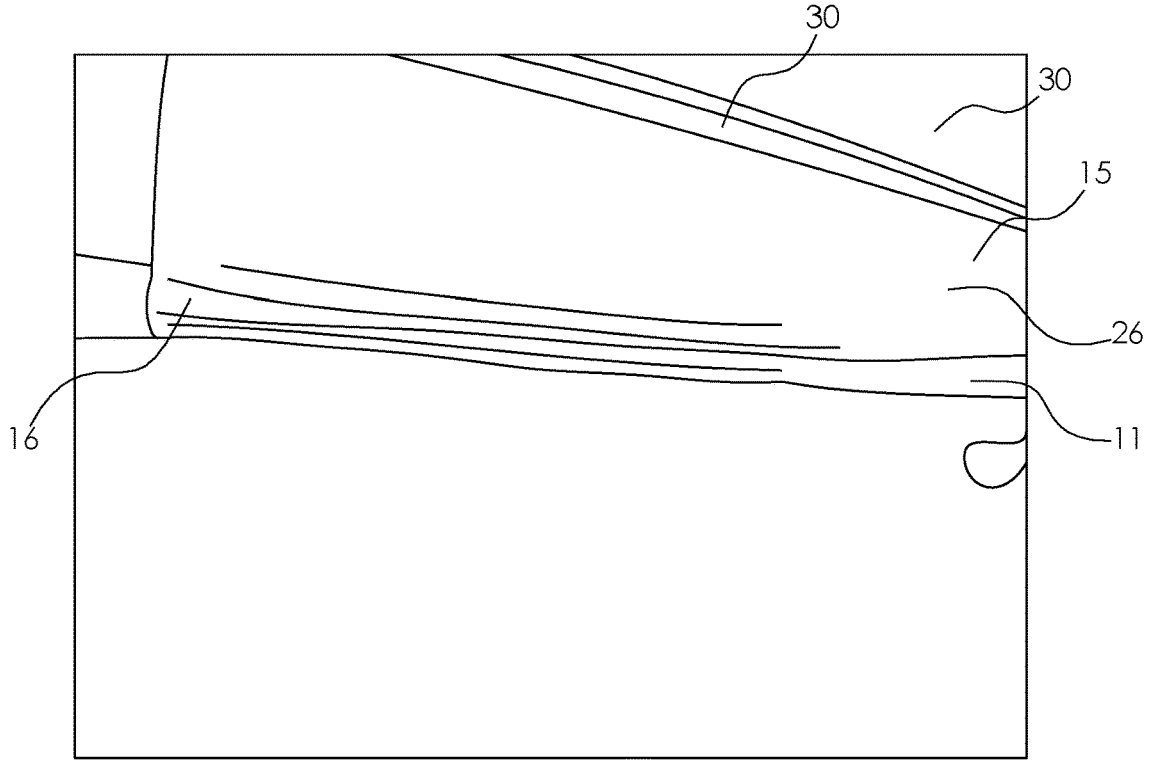
Figure 21:
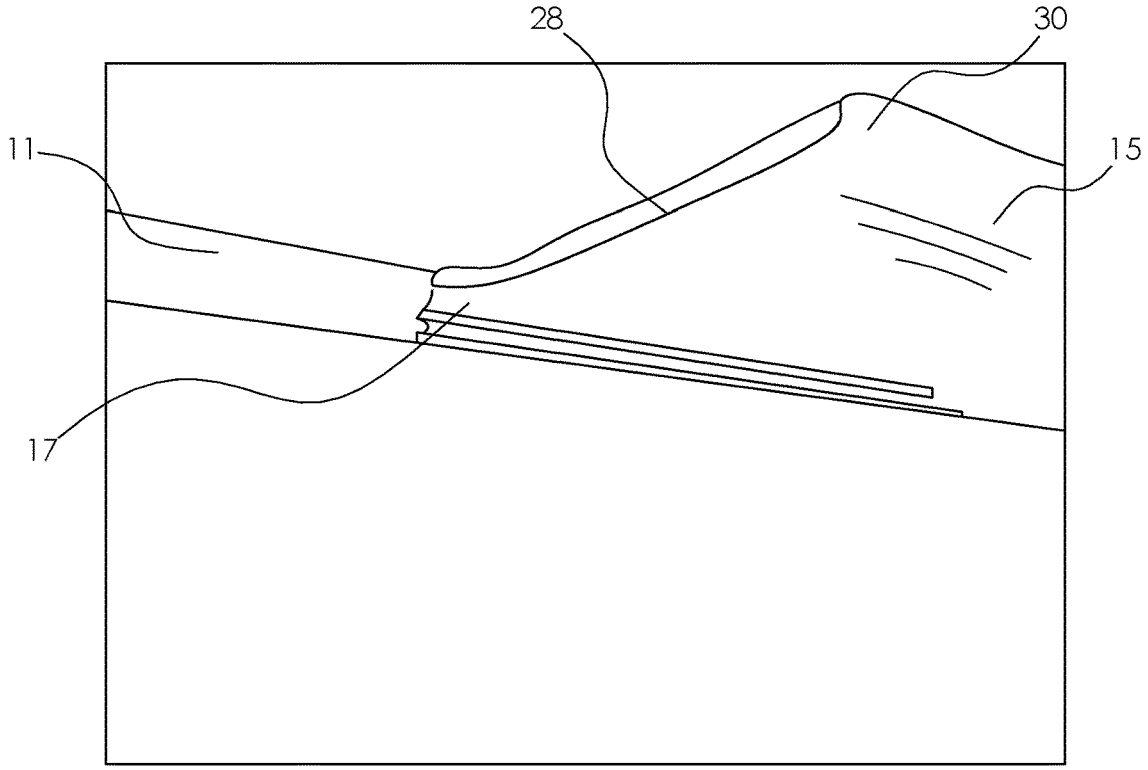
Figure 22:
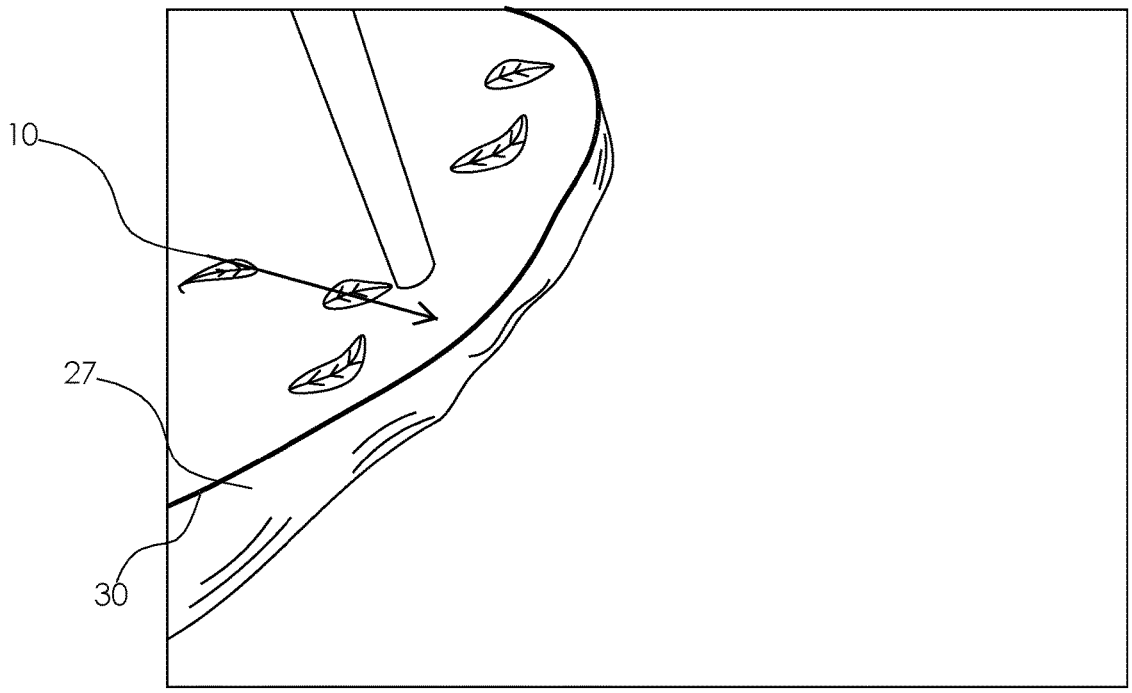
Figure 23:
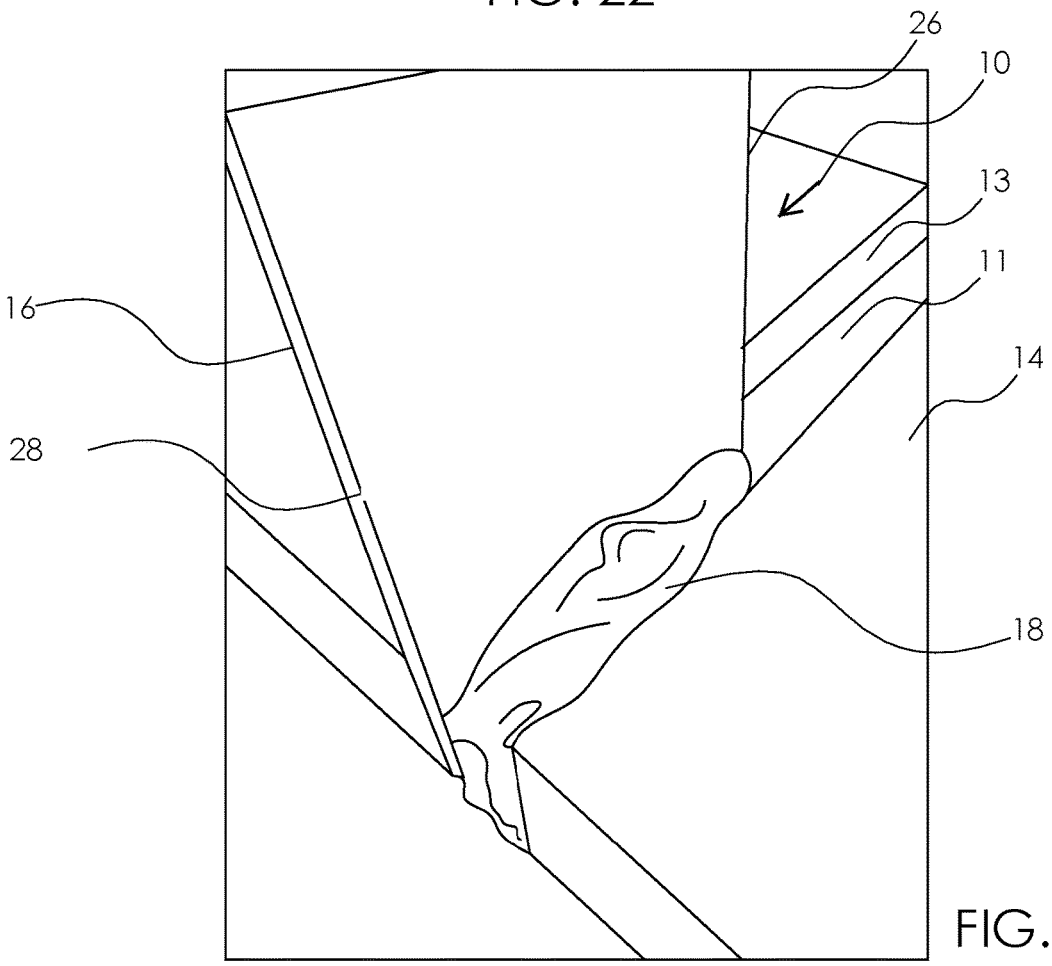
Figure 24:
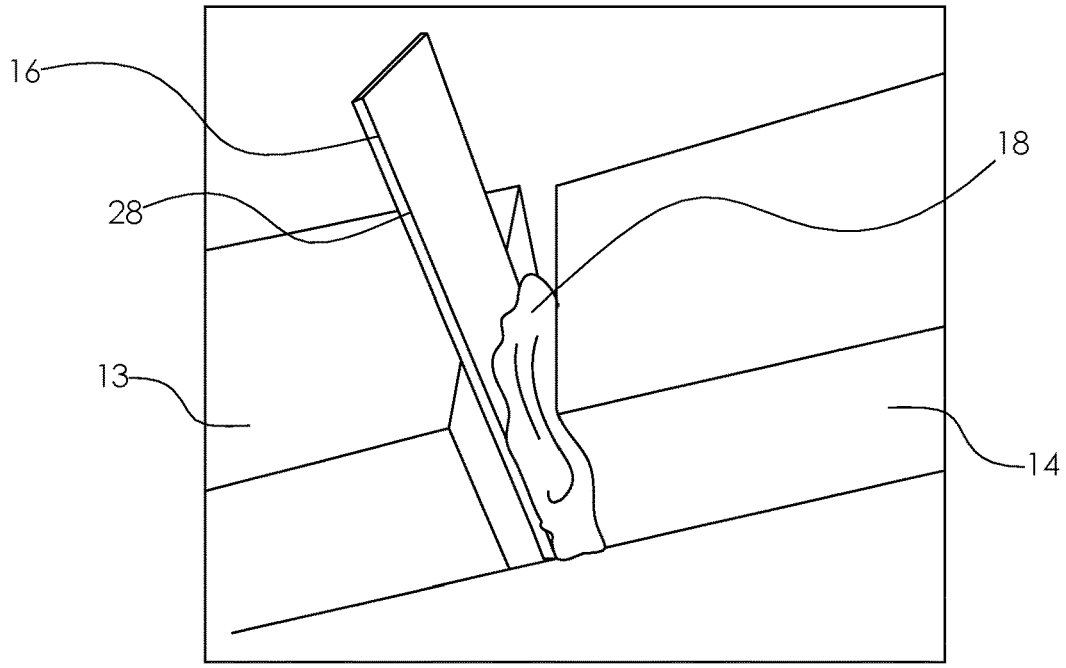
Figure 25:
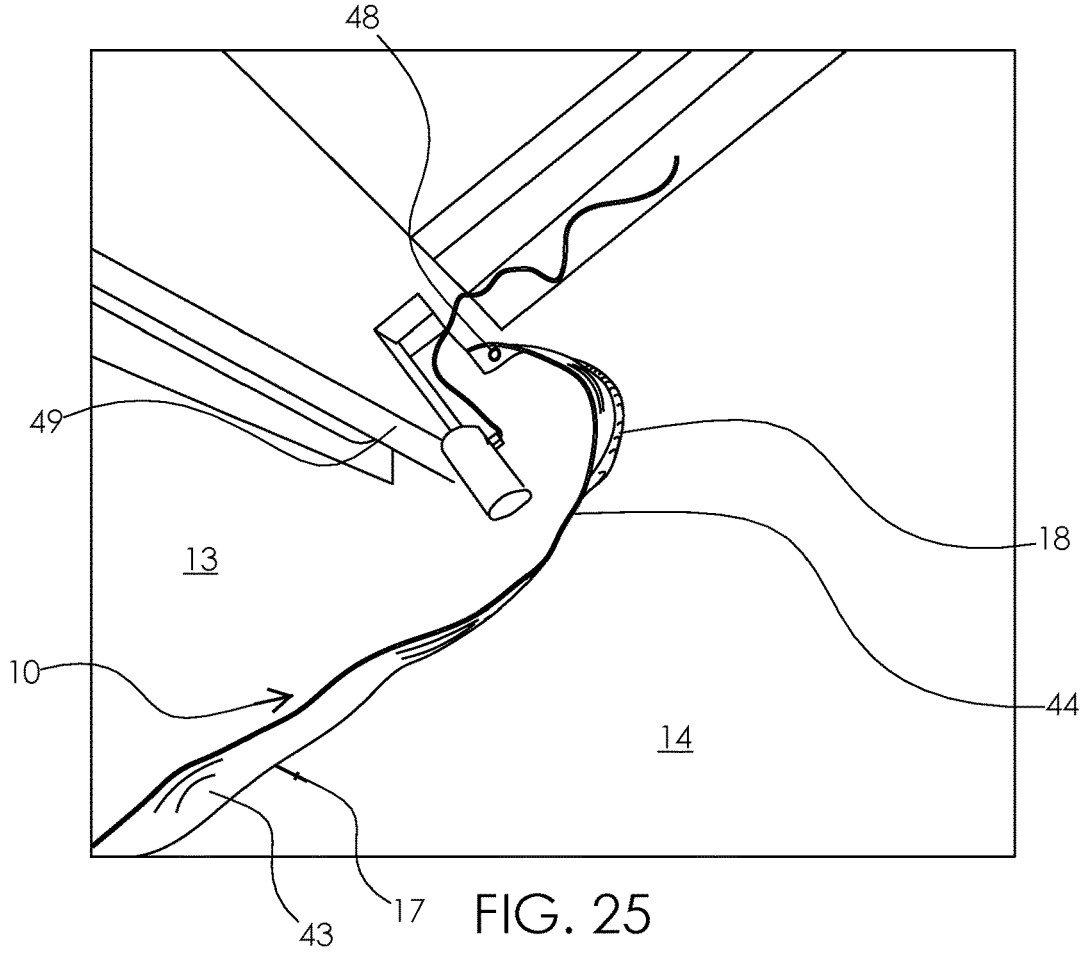
Figure 26:
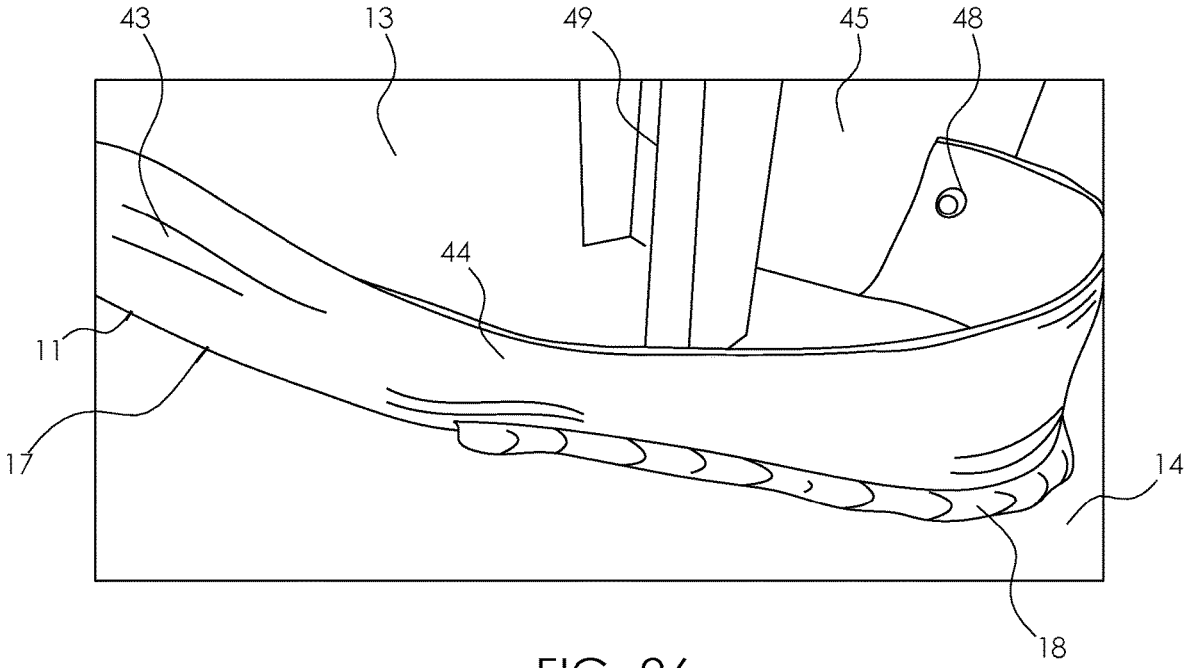
Figure 27:
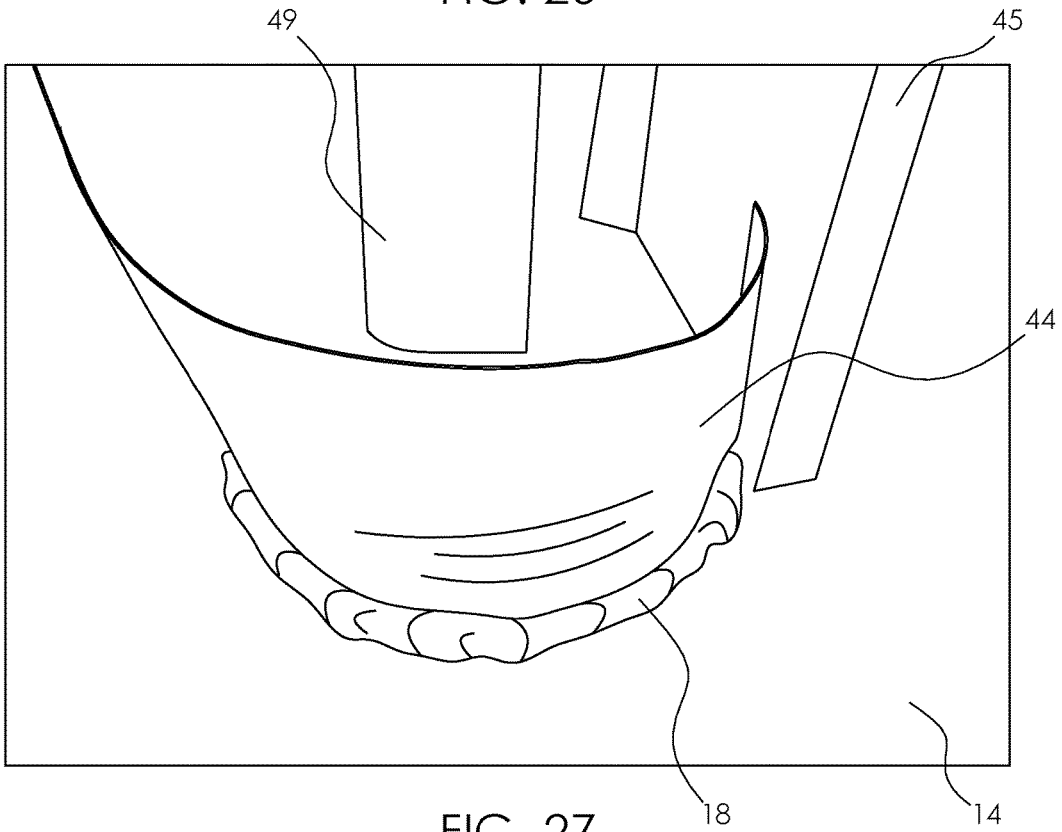

FIG. 11*a* is another perspective view showing the posterior side of the garage floor barricade;

FIG. 12 is another perspective view of the garage floor barricade;

FIG. 13 is a perspective view showing a cartoon housing a roll of the garage door barricade;

FIG. 14 is a cross-sectional view taken along the body of the garage floor barricade, showing the uniform cross-sectional thickness thereof;

FIG. 15 is another cross-sectional view taken along the body of the garage floor barricade, showing the uniform cross-sectional thickness thereof;

FIG. 16 is another perspective view showing the barricade installed in the seam between the two slabs of concrete at the garage door entrance;

FIG. 17 is an enlarged view of the seam shown in FIG. 16;

FIG. 18 is an enlarged perspective view showing the flange top edge, the medial portion, and the flanged bottom edge of the body;

FIG. 19 is another enlarged perspective view showing the flange top edge, the medial portion, and the flanged bottom edge of the body;

FIG. 20 is another enlarged perspective view showing the flange top edge, the medial portion, and the flanged bottom edge of the body;

FIG. 21 is another enlarged perspective view showing an end of the body wherein the flanged bottom edge is anchored in the seam of two adjoining concrete slabs;

FIG. 22 is another perspective view of the garage floor barricade wherein a central portion of the barricade is anchor in the floor seam and an end portion of the barricade is continued beyond the floor seam and anchored to a vertical support wall (e.g., drywall);

FIG. 23 is another enlarged cross-sectional view showing fastener morphed into the seam and pressed against the flanged bottom edge for anchoring the body between the two adjoining concrete slabs;

FIG. 24 is another enlarged cross-sectional view showing fastener morphed into the seam and pressed against the flanged bottom edge for anchoring the body between the two adjoining concrete slabs;

FIG. 25 is another perspective view of the garage floor barricade shown in FIG. 22 wherein the central portion of the barricade is anchored in the floor seam and the end portion of the barricade is continued beyond the floor seam and anchored to a vertical support wall (e.g., drywall);

FIG. 26 is another perspective view of the garage floor barricade shown in FIG. 25 wherein the central portion of the barricade is anchored in the floor seam and the end portion of the barricade is continued beyond the floor seam and anchored to a vertical support wall (e.g., drywall); and FIG. 27 is an enlarged side elevational view of the garage floor barricade shown in FIG. 26 wherein the central portion of the barricade is anchored in the floor seam and an end portion of the barricade is continued beyond the floor seam and anchored to a vertical support wall (e.g., drywall) with adhesive material engaged along the medial portion thereof (e.g., bottom edge is cut off the barricade body).

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about," "generally," and "approximately" mean nearly and in the context of a numerical value or range set forth means±15% of the numerical.

If used herein, "substantially" means largely if not wholly that which is specified but so close that the difference is insignificant.

The term "planar" means when the barricade 10 is not bent or flexed to a tensioned shape.

A non-limiting exemplary embodiment(s) of the present disclosure is referred to generally in FIGS. 1-27 and is intended to provide a specially configured garage floor barricade 10 that is inserted into a seam 11 between two slabs of concrete 13, 14 at a garage floor entrance 12 of a garage for prohibiting fluid and debris from traveling past the garage floor entrance 12 (e.g., ground level) into the garage. It should be understood that the exemplary embodiment(s) may be used with a variety of garage floors, and should not be limited to any particular garage floor described herein.

Referring generally to FIGS. 1-27, the garage floor barricade 10 for prohibiting fluid and debris from traveling beyond a threshold location 12 into the garage. Such a garage floor barricade 10 includes a body 15 having a planar medial portion 16 and a flanged bottom edge 17 directly engaged thereto. A flanged (beveled) top edge 30 is monolithically formed with the planar medial portion 16. Such a flanged top edge 30 faces upwardly and opposite to the flanged bottom edge 17. Thus, the flanged top edge 30 faces posterior of the body 15 and the flanged bottom edge 17 faces anterior of the body 15. Advantageously, the flanged bottom edge 17 is configured to be inserted into an existing seam 11 between two existing slabs of concrete 13, 14 located at the existing garage floor entrance 12 of the garage. A morphable adhesive member 18 is configured to be deposited into the seam 11 and configured to be engaged with the flanged bottom edge 17 such that the planar medial portion 16 of the body 15 remains upright above the seam 11 between the two existing slabs of concrete 13, 14. Notably, the body 15 has a centrally registered axis 19 aligned with the planar medial portion 16 and offset from the flanged bottom edge 17. In this manner, the body 15 has a uniform height 20 extended along an entire longitudinal length thereof. Such a structural configuration yields the new, useful, and unpredicted result of preventing fluid and debris from entering the garage over extended time periods by solving the problem of undesirably body 15 warping and detachment from the seam 11 along the garage floor when vehicles and pedestrians drive over the body 15.

In a non-limiting exemplary embodiment, the body 15 is single, unitary, and continuous and includes an elastomeric material (e.g., rubber). Such a structural configuration yields the new, useful, and unpredicted result of preventing fluid and debris from entering the garage over extended time periods by solving the problem of undesirably body 15 warping and detachment from the seam 11 along the garage floor when vehicles and pedestrians drive over the body 15.

In a non-limiting exemplary embodiment, the body 15 is a rubber wall base configured to be affixed against an existing interior drywall (e.g., ROPPE™ 700 series TP rubber wall base). Such a structural configuration yields the new, useful, and unpredicted result of preventing fluid and debris from entering the garage over extended time periods by solving the problem of undesirably body 15 warping and detachment from the seam 11 along the garage floor when vehicles and pedestrians drive over the body 15.

In a non-limiting exemplary embodiment, the planar medial portion 16 is monolithically attached to the flanged bottom edge 17. The planar medial portion 16 has a smooth and continuous anterior face 26 and a smooth and continuous posterior face 27. Such a structural configuration yields the new, useful, and unpredicted result of preventing fluid and debris from entering the garage over extended time periods by solving the problem of undesirably body 15 warping and detachment from the seam 11 along the garage floor when vehicles and pedestrians drive over the body 15.

In a non-limiting exemplary embodiment, the smooth and continuous anterior face 26 is symmetrical to and a mirror image of the smooth and continuous posterior face 27. Such a structural configuration yields the new, useful, and unpredicted result of preventing fluid and debris from entering the garage over extended time periods by solving the problem of undesirably body 15 warping and detachment from the seam 11 along the garage floor when vehicles and pedestrians drive over the body 15.

In a non-limiting exemplary embodiment, the flanged bottom edge 17 protrudes outwardly and downwardly away from the smooth and continuous anterior face 26. Such a structural configuration yields the new, useful, and unpredicted result of preventing fluid and debris from entering the garage over extended time periods by solving the problem of undesirably body 15 warping and detachment from the seam 11 along the garage floor when vehicles and pedestrians drive over the body 15.

In a non-limiting exemplary embodiment, the body 15 is flexible, resilient and includes a surface area having a uniform cross-sectional thickness 28. Such a structural configuration yields the new, useful, and unpredicted result of preventing fluid and debris from entering the garage over extended time periods by solving the problem of undesirably body 15 warping and detachment from the seam 11 along the garage floor when vehicles and pedestrians drive over the body 15.

In a non-limiting exemplary embodiment, the body 15 is configured to extend orthogonally upward from the existing garage floor entrance 12 along the centrally registered axis 19. Such a structural configuration yields the new, useful, and unpredicted result of preventing fluid and debris from entering the garage over extended time periods by solving the problem of undesirably body 15 warping and detachment from the seam 11 along the garage floor when vehicles and pedestrians drive over the body 15.

In a non-limiting exemplary embodiment, the adhesive member 18 includes a silicon directly abutted against the smooth and continuous anterior face 26 and the flanged bottom edge 17. Such that the silicon is configured to morph and fill the existing seam 11 up to the existing garage floor entrance 12. Such a structural configuration yields the new, useful, and unpredicted result of preventing fluid and debris from entering the garage over extended time periods by solving the problem of undesirably body 15 warping and detachment from the seam 11 along the garage floor when vehicles and pedestrians drive over the body 15.

The present disclosure further includes a method of utilizing a garage floor barricade 10 for prohibiting fluid and debris from traveling beyond a threshold location 12 into the garage. Such a method includes the steps of: providing a rolled body 15 having a planar medial portion 16 and a flanged bottom edge 17 directly engaged thereto wherein the body 15 has a centrally registered axis 19 aligned with the planar medial portion 16 and offset from the flanged bottom edge 17, and further has a uniform height 20 extending along an entire longitudinal length thereof; accessing an existing seam 11 between two existing slabs of concrete 13, 14 located at the existing garage floor entrance 12 of the garage; unrolling and inserting the flanged bottom edge 17 into the existing seam 11 between the two existing slabs of concrete 13, 14 located at the existing garage floor entrance 12 of the garage; providing an adhesive member 18; depositing the adhesive member 18 into the seam 11; and engaging the adhesive member 18 with the flanged bottom edge 17 such that the planar medial portion 16 of the body 15 remains upright above the seam 11 between the two existing slabs of concrete 13, 14. Such a methodology yields the new, useful, and unpredicted result of preventing fluid and debris from entering the garage over extended time periods by solving the problem of undesirably body 15 warping and detachment from the seam 11 along the garage floor when vehicles and pedestrians drive over the body 15.

Referring to FIGS. 1-27 in general, in a non-limiting exemplary embodiment(s), the garage floor debris barricade 10 is inserted into a seam 11 between two slabs of concrete 13, 14, and the flexible rubber barricade 10 is used to prevent debris, fluids, etc. from entering the garage. In particular, the garage floor debris barricade 10, which is normally used as an interior rubber and/or vinyl baseboard for drywall, is used as the continuous barricade 10 to prevent ground level objects from entering the garage.

In a non-limiting exemplary embodiment, the barricade 10 has a single and continuous body 15 wound into a single and continuous roll. Such a body 15 may be a vulcanized rubber wall base, which is highly durable and extremely flexible, allowing for easy installation by simply unrolling a desired length of the body 15 to match a width of the garage floor opening.

In a non-limiting exemplary embodiment, the barricade 10 is preferably formed from flexible elastomeric material (rubber, synthetic rubber such as neoprene or a butadiene-styrene copolymer, and/or suitable thermoplastic polymers, such as polyethylene, polyurethane, polyvinyl chlorides, nylon or the like) which is capable of flexing as required and will withstand weather and repeated impact from heavy objects such as vehicles, lawn mowers, human traffic, etc.

In a non-limiting exemplary embodiment, the barricade 10 may be made in one rolled piece long enough to extend from side to side of the garage opening, In a non-limiting exemplary embodiment, extruded rigid body 15 has sufficient mechanical strength to attach to any surface to be sealed, such as a seam 11 between two slabs of concrete 13, 14. This connection may be made in a variety of ways such as by fastening the strip, via a suitable adhesive (e.g., glue, silicon, etc.), to the concrete 13, 14 seam 11 along the garage floor.

In a non-limiting exemplary embodiment, the flexible barricade 10 is secured to the floor of the structure or garage adjacent to the garage door to extend across the opening to intercept and/or deflect foreign matter that might pass along the ground and through said opening. In particular, the barricade 10 may be positioned interior of the garage door, for example.

In a non-limiting exemplary embodiment, the flexible barricade 10, preferably made of elastomeric material, comprises a planar central portion, a flanged bottom edge 17 contiguously and integrally formed with the planar central portion, and a beveled top edge 30 contiguously and integrally formed with the planar central portion. The flanged bottom edge 17 extends outwardly along an anterior direction away from the planar central portion. The beveled top edge 30 is curved inwardly along a posterior direction away from the planar central portion and opposite to the flanged bottom edge 17. Advantageously, the flexible barricade 10 is configured to be tucked into the seam 11 of two concrete 13, 14 slabs such that the upwardly projecting flexible planar central portion defines a barrier that engages and intercepts foreign objects such as leaves, grass clippings, snow and dirt or the like as might blow along the ground and through the garage floor opening and collect in the garage. Notably, the body 15 maintains an upright posture substantially perpendicular (vertical) relative to a horizontal ground surface.

In a non-limiting exemplary embodiment, the body 15, being flexible, and containing elastomeric material will deflect to permit a heavy object, such an automobile, lawn mower or work cart or the like, to pass thereover on entering or leaving the garage without interference and will thereafter return to normal position.

In a non-limiting exemplary embodiment, a further advantage is the body 15 is preferably positioned interior of the garage door which helps prevent or minimize sagging or bowing of the body 15 when the garage door is closed, especially where the garage door has significant weight and/or length.

In a non-limiting exemplary embodiment, the body 15 has a sufficiently low profile to minimize the friction of vehicle tires passing thereover, thereby minimizing the possibility of the body 15 moving after installation, and also to facilitate flushing out or sweeping out the garage floor. The profile is sufficiently raised, however, to provide a significant damming effect against moisture, rain or snow, dust and other objects traveling along the ground surface into the garage floor.

In a non-limiting exemplary embodiment, the body 15 may have a unique blend of thermoplastic rubber and vinyl that is extremely durable, attractive, and flexible. Such a thermoplastic body 15 maintains its shape for a secure fit, and superior durability that withstands scratches or scuffs as a result of daily wear.

Referring to FIGS. 22 and 25-27, the garage floor barricade 10 has a central portion 43 with bottom edge 17 anchored in the floor seam 11 and an end portion 44 of the barricade 10 is continued beyond the floor seam 11 and anchored to a vertical support wall 45 (e.g., drywall, base board, etc.) via a fastener 48. Adhesive member 18 is also deposited along the garage floor 14 and supports end portion 44 of barricade 10. The floor barricade 10 is directed around a garage door support member 49 and attached to an adjacent base board 45. At the end portion 44, bottom edge 17 has been cut and removed therefrom and disengaged from seam 11 between the adjoining concrete slabs 13, 14. This allows barricade to prevent fluid and debris from entering the garage floor entrance beyond the floor seam 11 because with the adhesive member 18 engages the concrete slabs 13, 14 and central portion 43.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A garage floor barricade for prohibiting fluid and debris from traveling beyond a threshold location into a garage, said garage floor barricade comprising:

a body having a planar medial portion and a flanged bottom edge directly engaged thereto, said flanged bottom edge is configured to be inserted into an existing seam between two existing slabs of concrete located at an existing garage floor entrance of the garage; and an adhesive member configured to be deposited into the existing seam and configured to be engaged with said flanged bottom edge such that said planar medial portion of said body remains upright above the existing seam between the two existing slabs of concrete;

wherein said body has a centrally registered axis aligned with said planar medial portion and offset from said flanged bottom edge;

wherein said body has a first planar and flat outermost surface and a second planar and flat outermost surface each spaced at opposed sides of the centrally registered longitudinal axis;

wherein said flanged bottom edge extends laterally away, in only one direction, from the centrally registered longitudinal axis;

wherein said body has one terminal end disposed exterior of and beyond the existing seam and affixed to an interior vertical wall of the garage away from the two existing slabs of concrete;

wherein a major surface area of said body remains exposed above the existing seam at the existing garage floor entrance of the garage such that fluid and debris are prohibited from traveling over said body and entering the garage.

2. The garage floor barricade of claim 1, wherein said body is single, unitary, and continuous; wherein said body comprises: an elastomeric material.

3. The garage floor barricade of claim 2, wherein said body is a rubber wall base board configured to be affixed against an existing interior drywall.

4. The garage floor barricade of claim 3, wherein said planar medial portion is monolithically attached to said flanged bottom edge, said planar medial portion having a continuous anterior face and a continuous posterior face.

5. The garage floor barricade of claim 4, wherein said continuous anterior face is symmetrical to and a mirror image of said continuous posterior face.

6. The garage floor barricade of claim 5, wherein said flanged bottom edge protrudes outwardly and downwardly away from said continuous anterior face.

7. The garage floor barricade of claim 6, wherein said body is flexible, resilient and includes a surface area having a uniform cross-sectional thickness.

8. The garage floor barricade of claim 7, wherein said body is configured to extend orthogonally upward from the existing garage floor entrance along the centrally registered axis.

9. The garage floor barricade of claim 8, wherein said adhesive member comprises: silicon directly abutted against said continuous anterior face and said flanged bottom edge, wherein said silicon is configured to fill the existing seam up to the existing garage floor entrance.

10. A garage floor barricade for prohibiting fluid and debris from traveling beyond a threshold location into a garage, said garage floor barricade comprising:

a body having a planar medial portion and a flanged bottom edge directly engaged thereto, said flanged bottom edge is configured to be inserted into an existing seam between two existing slabs of concrete located at an existing garage floor entrance of the garage; and an adhesive member configured to be deposited into the existing seam and configured to be engaged with said flanged bottom edge such that said planar medial portion of said body remains upright above the existing seam between the two existing slabs of concrete;

wherein said body has a centrally registered axis aligned with said planar medial portion and offset from said flanged bottom edge;

wherein said body has a uniform height extended along an entire longitudinal length thereof;

wherein said body is single, unitary, and continuous; wherein said body includes an elastomeric material;

wherein said body is a rubber wall base board configured to be affixed against an existing interior drywall;

wherein said planar medial portion is monolithically attached to said flanged bottom edge, said planar medial portion having a continuous anterior face and a continuous posterior face;

wherein said continuous anterior face is symmetrical to and a mirror image of said continuous posterior face;

wherein said flanged bottom edge protrudes outwardly and downwardly away from said continuous anterior face;

wherein said body is flexible, resilient and includes a surface area having a uniform cross-sectional thickness;

wherein said body is configured to extend orthogonally upward from the existing garage floor entrance along the centrally registered axis;

wherein said adhesive member includes silicon directly abutted against said continuous anterior face and said flanged bottom edge, wherein said silicon is configured to fill the existing seam up to the existing garage floor entrance;

wherein a major surface area of said body remains exposed above the existing seam at the existing garage floor entrance of the garage such that fluid and debris are prohibited from traveling over said body and entering the garage.

11. A method of utilizing a garage floor barricade for prohibiting fluid and debris from traveling beyond a threshold location into a garage, said method comprising the steps of:

providing a body having a planar medial portion and a flanged bottom edge directly engaged thereto, said body having a centrally registered axis aligned with said planar medial portion and offset from said flanged bottom edge, said body having a uniform height extending along an entire longitudinal length thereof;

accessing an existing seam between two existing slabs of concrete located at an existing garage floor entrance of the garage;

inserting said flanged bottom edge into the existing seam between the two existing slabs of concrete located at the existing garage floor entrance of the garage;

providing an adhesive member;

depositing said adhesive member into the existing seam; and engaging said adhesive member with said flanged bottom edge such that said planar medial portion of said body remains upright above the existing seam between the two existing slabs of concrete;

wherein a major surface area of said body remains exposed above the existing seam at the existing garage floor entrance of the garage such that fluid and debris are prohibited from traveling over said body and entering the garage.

* * * * *